US006193847B1

(12) United States Patent
Trokhan

(10) Patent No.: US 6,193,847 B1
(45) Date of Patent: Feb. 27, 2001

(54) PAPERMAKING BELTS HAVING A PATTERNED FRAMEWORK WITH SYNCLINES THEREIN

(75) Inventor: Paul Dennis Trokhan, Hamilton, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/591,738

(22) Filed: Jun. 12, 2000

Related U.S. Application Data

(63) Continuation of application No. 09/346,061, filed on Jul. 1, 1999, now Pat. No. 6,117,270.

(51) Int. Cl.[7] ..... D21F 7/08; D21F 1/10; B32F 7/02

(52) U.S. Cl. ..... 162/358.1; 162/348; 162/903; 162/900; 162/902

(58) Field of Search ..... 162/358.1, 348, 162/900–904; 428/247, 131, 252, 255, 260, 265, 137, 229, 135; 42/33

(56) References Cited

U.S. PATENT DOCUMENTS

| | | | |
|---|---|---|---|
| 3,905,863 | 9/1975 | Ayers . | |
| 4,239,065 | 12/1980 | Trokhan . | |
| 4,514,345 | 4/1985 | Johnson et al. . | |
| 4,528,239 | 7/1985 | Trokhan . | |
| 5,098,522 | 3/1992 | Smurkoski et al. . | |
| 5,275,700 | 1/1994 | Trokhan . | |
| 5,334,289 | 8/1994 | Trokhan et al. . | |
| 5,431,786 | 7/1995 | Rasch et al. . | |
| 5,496,624 | 3/1996 | Stelljes, Jr. et al. . | |
| 5,500,277 | 3/1996 | Trokhan et al. . | |
| 5,503,715 | 4/1996 | Trokhan et al. . | |
| 5,549,790 | 8/1996 | Phan | 162/109 |
| 5,554,467 | 9/1996 | Trokhan et al. . | |
| 5,556,509 | 9/1996 | Trokhan et al. | 162/111 |
| 5,628,876 | 5/1997 | Ayers et al. . | |
| 5,700,356 | * 12/1997 | Lefkowitz | 162/358.1 |
| 5,709,775 | 1/1998 | Trokhan et al. | 162/117 |
| 5,714,041 | 2/1998 | Ayers et al. . | |
| 5,804,036 | 9/1998 | Phan et al. . | |
| 5,804,281 | 9/1998 | Phan et al. . | |
| 5,814,190 | 9/1998 | Phan | 162/111 |
| 5,900,122 | 5/1999 | Huston . | |
| 5,904,811 | 5/1999 | Ampulski et al. | 162/117 |
| 5,906,710 | 5/1999 | Trokhan . | |

* cited by examiner

*Primary Examiner*—Stanley S. Silverman
*Assistant Examiner*—Jose A. Fortuna
(74) *Attorney, Agent, or Firm*—Larry L. Huston; Tara M. Rosnell

(57) ABSTRACT

A papermaking belt and paper made thereon. The papermaking belt comprises a patterned framework and a reinforcing element. The papermaking belt may be used as a through air drying belt, a forming wire, a backing wire, a conventional press felt, etc. The papermaking belt has a reinforcing element and a framework extending from the reinforcing element. Intermediate various portions of the framework are deflection conduits. The framework is interrupted and subdivided by synclines. The framework, synclines and deflection conduits respectively impart first, second and third values of intensive properties to regions of the paper made on these portions of the belt. The value of the intensive property of the regions of the paper corresponding to the synclines is intermediate the value of the regions of the paper corresponding to the framework and deflection conduits. For example, if the papermaking belt according to the present invention is used as a through air drying belt, the density of the regions of the paper corresponding to the synclines will be less than the density of the regions of the paper corresponding to the framework but greater than the density of the regions corresponding to the deflection conduits. Conversely, if the papermaking belt according to the present invention is used as a forming wire, the basis weight of the regions of the paper corresponding to the synclines will be greater than the basis weight of the regions corresponding to the framework but less than the basis weight of the regions corresponding to the deflection conduits.

15 Claims, 12 Drawing Sheets

PAPERMAKING BELTS HAVING A PATTERNED FRAMEWORK WITH SYNCLINES THEREIN

This application is a continuation of U.S. Ser. No. 09/346,061, filed on Jul. 1, 1999, now U.S. Pat. No. 6,117,270.

FIELD OF THE INVENTION

The present invention relates to a papermaking belt, and more particularly to such belts having a patterned framework. The invention also relates to the paper made with such belts.

BACKGROUND OF THE INVENTION

Paper products are a staple of every day life. Paper products are used as bath tissue, facial tissue, paper toweling, napkins, etc. Typically, such paper products are made by depositing an aqueous slurry of cellulosic fibers from a headbox. The aqueous carrier is removed, leaving the cellulosic fibers to form an embryonic web which is dried to form a paper sheet. The cellulosic fibers may be dried with press felts, by through air drying or by any other suitable means.

A particularly preferred through air drying apparatus utilizes a through air drying papermaking belt having a patterned framework. The framework may comprise an essentially continuous network made of a photosensitive resin with discrete deflection conduits therethrough. The essentially continuous network provides an imprinting surface which densifies a corresponding essentially continuous network into the paper being manufactured.

The discrete, isolated deflection conduits of the through air drying belt form domes in the paper. Other geometries of the framework and deflection conduits are known in the art. For example, the framework and deflection conduits may both be semicontinuous, or the deflection conduits may be continuous and the framework discontinuous.

The domes form low density regions in the paper and improve the caliper, bulk, absorbency and softness of the paper. Through air drying on a photosensitive resin belt has numerous advantages, as illustrated by the commercially successful Bounty® paper towel, Charmin® bath tissue and Charmin Ultra® bath tissue, all sold by the assignee of the present invention.

The through air drying process is preferrably accomplished with some lateral leakage of air within the plane of the belt. The lateral leakage may occur at the backside of the belt, as disclosed in the prior art. Alternatively, the lateral leakage may occur across the top surface of the belt with the present invention.

The present invention provides even softer paper, yet retains the advantages of paper manufactured with the aforementioned photosensitive resin through air drying belts. This is accomplished by providing hinge lines in the imprinting surface of the papermaking belt. This invention further provides paper, including through air dried paper, having improved softness obtained by modifying the high density region of the paper from the teachings of the prior art.

SUMMARY OF THE INVENTION

The invention comprises a papermaking belt. The papermaking belt comprises a reinforcing element and a framework. The element may be a woven element, suitable for through air drying, may comprise a conventional press felt or may comprise a conventional press felt. The framework comprises a macroscopically monoplanar network surface optionally usable for imprinting paper. The network surface is interrupted by synclines which do not imprint the paper.

In another embodiment, the invention comprises paper. The paper may be imprinted, and have an imprinted region having a first density, synclinal interruptions in the imprinted region having a second density, and non-imprinted deflected regions having a third density. The density of the imprinted regions is greater than the density of the synclinal interruptions. The density of the synclinal interruptions is greater than the density of the nonimprinted deflected regions.

DESCRIPTION OF THE DRAWINGS

FIG. 1B achieves anisotropic disposition by having more machine direction oriented synclines than cross machine direction oriented synclines. FIG. 1C achieves the anisotropic distribution by having synclines extending outwardly from the deflection conduits and which are more closely aligned with the machine direction than with the cross machine direction.

FIG. 10B illustrates both straight and curved discrete synclines.

DETAILED DESCRIPTION OF THE INVENTION

Figure 1A:
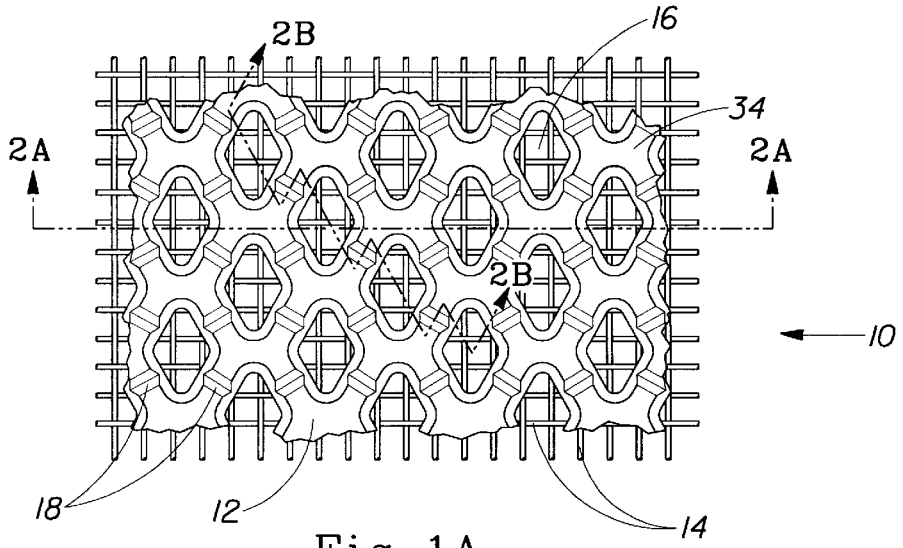
FIG. 1A is a fragmentary top plan view of a papermaking belt according to the present invention.
Figure 2A:
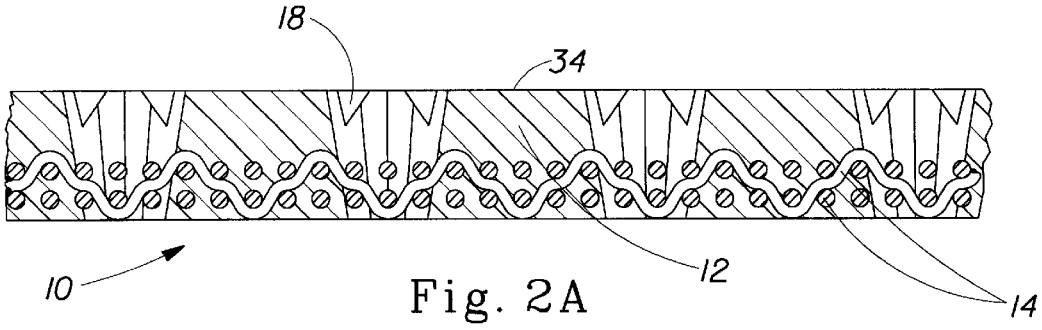
FIGS. 2A and 2B are offset vertical sectional views of the belt of FIG. 1 taken along lines 2A—2A and 2B—2B, respectively.
Figure 2B:
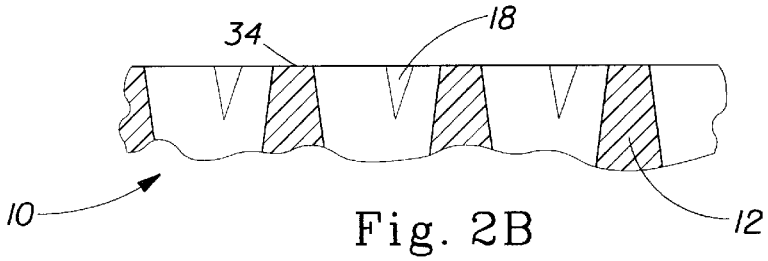

Referring to FIGS. 1A, 2A and 2B, the papermaking belt 10 according to the present invention is useful for papermaking. The papermaking belt 10 may be used as a through air drying belt, a forming wire, a backing wire for a twin wire former, a transfer belt, or, with appropriate batting, as a press felt, etc. Except as noted, the following discussion is directed to a through air drying belt although the foregoing executions are contemplated to be within the scope of the invention. The belt 10 may also be used in a crescent former where the belt 10 acts as both a backing wire and a through air drying belt 10 or press felt.

The belt 10 according to the present invention is macroscopically monoplanar. The plane of the papermaking belt 10 defines the X-Y directions. Perpendicular to the X-Y directions and the plane of the papermaking belt 10 is the Z-direction of the belt 10. Likewise, the paper 20 according to the present invention can be thought of as macroscopically monoplanar and lying in an X-Y plane. Perpendicular to the X-Y directions and the plane of the paper 20 is the Z-direction of the paper 20.

The belt 10 comprises two primary components: a framework 12 and a reinforcing element 14. The framework 12 may comprise a molded or extruded thermoplastic or pseudo-thermoplastic material and preferably comprises a cured polymeric photosensitive resin. The reinforcing element 14 may comprise a woven fabric as is known in the art. The framework 12 and belt 10 have a first surface which defines the paper contacting side of the belt 10 and an opposed second surface oriented towards the papermaking machine on which the belt 10 is used. The framework 12 has synclines 18 therein, as further described below.

The framework 12 is disposed on and defines the first surface of the belt 10. Preferably the framework 12 defines a predetermined pattern, which imprints a like pattern onto the paper 20 of the invention. Deflection conduits 16 extend between the first surface and the second surface. The framework 12 borders and defines the deflection conduits 16. One preferred, and typical geometry comprises a framework 12 which defines an essentially continuous network (hereinafter a continuous framework 12) and discrete isolated (hereinafter discontinuous) deflection conduits 16.

Suitable belts 10 having a continuous framework 12 and discontinuous deflection conduits 16 are illustrated in commonly assigned U.S. Pat. Nos. 4,514,345, issued Apr. 30, 1985 to Johnson et al.; 4,528,239, issued Jul. 9, 1985 to Trokhan; 5,098,522, issued Mar. 24, 1992; 5,260,171, issued Nov. 9, 1993 to Smurkoski et al.; 5,275,700, issued Jan. 4, 1994 to Trokhan; 5,328,565, issued Jul. 12, 1994 to Rasch et al.; 5,334,289, issued Aug. 2, 1994 to Trokhan et al.; 5,431,786, issued Jul. 11, 1995 to Rasch et al.; 5,496,624, issued Mar. 5, 1996 to Stelljes, Jr. et al.; 5,500,277, issued Mar. 19, 1996 to Trokhan et al.; 5,514,523, issued May 7, 1996 to Trokhan et al.; 5,554,467, issued Sep. 10, 1996, to Trokhan et al.; 5,566,724, issued Oct. 22, 1996 to Trokhan et al.; 5,624,790, issued Apr. 29, 1997 to Trokhan et al.; and, 5,679,222 issued Oct. 21, 1997 to Rasch et al., the disclosures of which are incorporated herein by reference.

The second surface of the belt 10 is the machine contacting surface of the belt 10. The second surface may have a backside network with passageways therein which are distinct from the deflection conduits 16. The passageways provide irregularities in the texture of the backside of the second surface of the belt 10. The passageways allow for air leakage in the X-Y plane of the belt 10, which leakage does not necessarily flow in the Z-direction through the deflection conduits 16 of the belt 10.

The second primary component of the belt 10 according to the present invention is the reinforcing element 14. The reinforcing element 14, like the framework 12, has a paper facing side and a machine facing side opposite the paper facing side. The reinforcing element 14 is primarily disposed between the opposed surfaces of the belt 10 and may have a surface coincident the backside of the belt 10. The reinforcing element 14 provides support for the framework 12. The reinforcing element 14 is typically woven, as is well known in the art.

The portions of the reinforcing element 14 registered with the deflection conduits 16 prevent fibers used in papermaking from passing completely through the deflection conduits 16, and thereby reduce the occurrences of pinholes. If one does not wish to use a woven fabric for the reinforcing element 14, a nonwoven element, screen, net, press felt or a plate or film having a plurality of holes therethrough may provide adequate support and strength for the framework 12 of the present invention. Suitable reinforcing elements 14 may be made according to commonly assigned U.S. Pat. Nos. 5,496,624, issued Mar. 5, 1996 to Stelljes, et al., 5,500,277 issued Mar. 19, 1996 to Trokhan et al., and 5,566,724 issued Oct. 22, 1996 to Trokhan et al., the disclosures of which are incorporated herein by reference.

If desired, the belt 10 may be executed as a press felt, as is commonly used in conventional drying, and is well known in the art. A suitable press felt for use according to the present invention may be made according to the teachings of commonly assigned U.S. Pat. Nos. 5,549,790, issued Aug. 27, 1996 to Phan; 5,556,509, issued Sep. 17, 1996 to Trokhan et al.; 5,580,423, issued Dec. 3, 1996 to Ampulski et al.; 5,609,725, issued Mar. 11, 1997 to Phan; 5,629,052 issued May 13, 1997 to Trokhan et al.; 5,637,194, issued Jun. 10, 1997 to Ampulski et al.; 5,674,663, issued Oct. 7, 1997 to McFarland et al.; 5,693,187 issued Dec. 2, 1997 to Ampulski et al.; 5,709,775 issued Jan. 20, 1998 to Trokhan et al.; 5,776,307 issued Jul. 7, 1998 to Ampulski et al.; 5,795,440 issued Aug. 18, 1998 to Ampulski et al.; 5,814,190 issued Sept. 29, 1998 to Phan; 5,817,377 issued Oct. 6, 1998 to Trokhan et al.; 5,846,379 issued Dec. 8, 1998 to Ampulski et al.; 5,855,739 issued Jan. 5, 1999 to Ampulski et al.; and 5,861,082 issued Jan. 19, 1999 to Ampulski et al., the disclosures of which are incorporated herein by reference. In an alternative embodiment, the belt 10 may be executed as a press felt according to the teachings of U.S. Pat. No. 5,569,358 issued Oct. 29, 1996 to Cameron.

Referring to FIGS. 2A–2B, the belt 10 according to the present invention further comprises synclines 18 in the essentially continuous network comprising the framework 12. The synclines 18 intercept the paper facing side of the framework 12 and extend in the Z-direction into the framework 12. The "synclines" 18 are surfaces of the framework 12 having a Z-direction vector component extending from the first surface of the belt 10 towards the second surface of the belt 10. The synclines 18 do not extend completely through the framework 12, as do the deflection conduits 16. Thus, the difference between a syncline 18 and a deflection conduit 16 may be thought of as the deflection conduit 16 represents a through hole in the framework 12, whereas a syncline 18 represents a blind hole, fissure, chasm, or notch in the framework 12. The synclines 18 in the framework 12 of the present invention allow for lateral leakage on the top side, i.e. the first surface, of the framework 12 between the felt 10 and the paper 20.

The imprinting surface may comprise one or a plurality of alternating synclines 18 and lands 34 respectively. As used herein, a "land" 34 refers to the surface of the framework 12 which is coincident the paper contacting side of the belt 10 and disposed between the synclines 18.

The synclines 18 may have an included angle of about 20 to about 120 degrees. The synclines 18 may taper to a vertex. The vertex defines the depth 30 of the syncline 18. Note, however, the syncline 18 may be concave and not have a specifically definable vertex.

Figure 4:
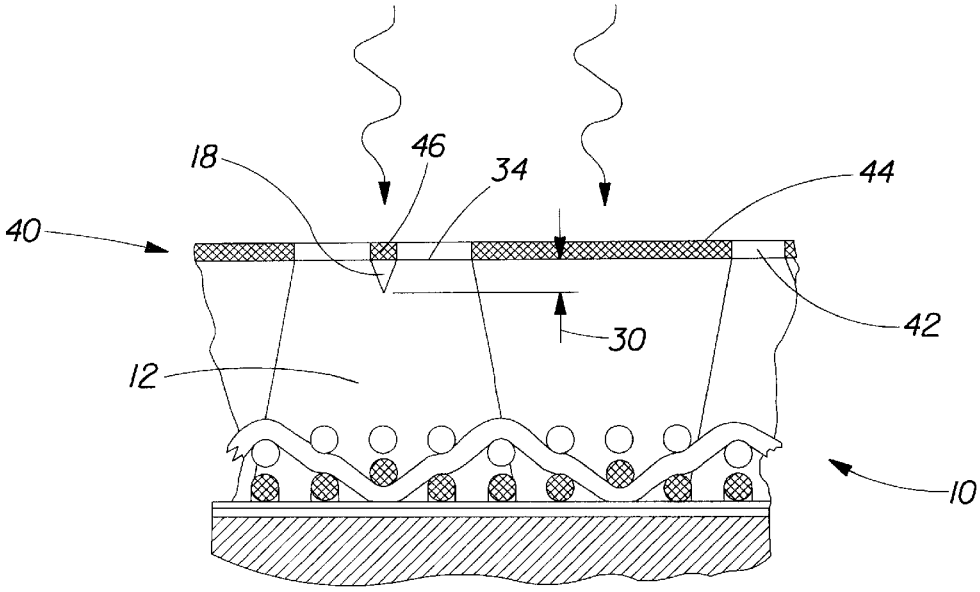
FIG. 4 is a fragmentary schematic side elevational view of a mask and liquid resin used to make a belt according to the present invention and showing the incident radiation upon the mask being blocked by an opaque region in the mask to form a syncline therebelow.
Figure 5A:
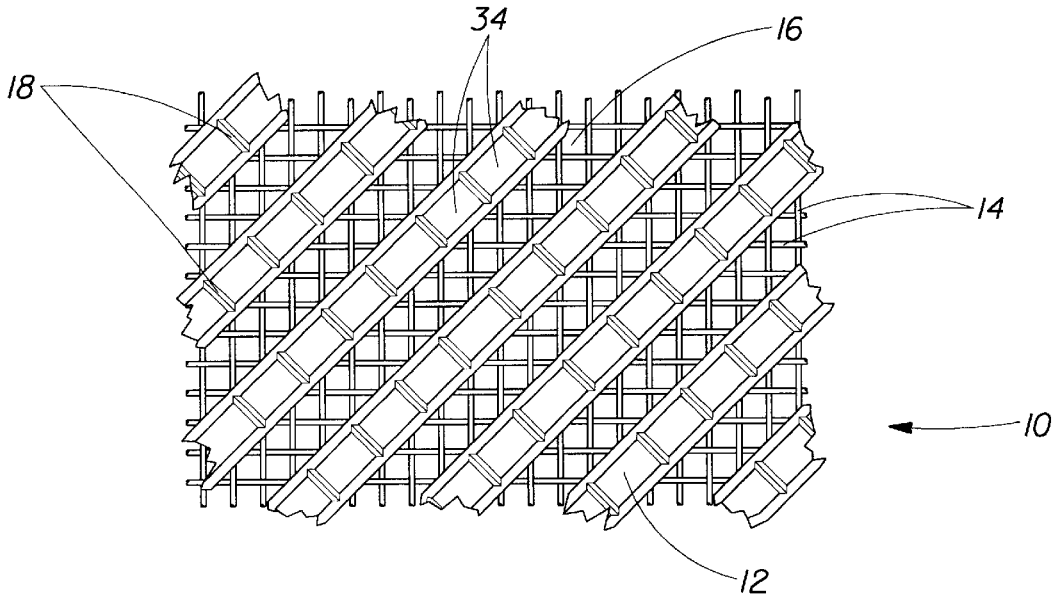
FIG. 5A is a top plan view of a papermaking belt having a discontinuous framework, discontinuous synclines and semicontinuous deflection conduits.
Figure 5B:
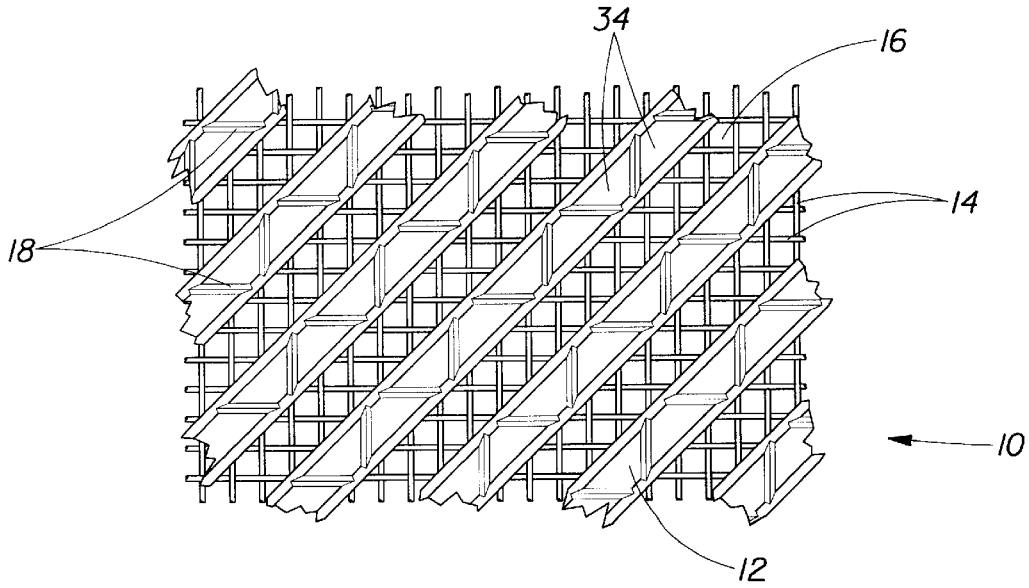
FIG. 5B is a top plan view of an alternative embodiment of the belt of FIG. 5A, having synclines non-perpendicularly disposed relative to the framework and deflection conduits.

Referring to FIG. 4, preferably the synclines 18 have a depth 30 of 10 percent (or less) to 100 percent of the thickness of the portion of the framework 12 extending outwardly from the reinforcing element 14. For a framework 12 having a thickness between the paper facing surface and the reinforcing element 14 of 0 to 100 mils., the syncline 18 may have a depth 30, measured inwardly from the first surface of the belt 10, of 0.2 to 100 mils. A mil is 0.001 inches or 0.00254 cm. If desired, the synclines 18 may have a depth 30 which extends below the surface of the reinforcing element 14, but not completely through the belt 10.

Referring to FIGS. 2A, 2B and 4, preferably the syncline 18 has a maximum dimension in the X-Y plane sufficiently small that the fibers forming the paper 20 of the present invention, whether cellulosic or synthetic, can bridge the syncline 18. This size allows the fiber to be bonded to other fibers at one, and preferably both, sides of the syncline 18 at the lands 34. By bonding the fiber which forms the syncline 18 in the paper 20 to other fibers in the essentially continuous network, improved strength will prophetically result in the paper 20 made thereon.

If predominantly softwood fibers are to be adjacent and in contact with the papermaking belt 10 of the present invention, preferably the synclines 18 have a maximum dimension in the X-Y plane of less than 6 millimeters, and more preferably less than 4 millimeters. If predominantly hardwood fibers are to be adjacent and in contact with the papermaking belt 10 of the present invention, preferably the maximum dimension of the syncline 18 in the X-Y plane is less than 2 millimeters, and preferably less than 1 millimeter. The lesser maximum dimension of the syncline 18 for papermaking belts 10 used in contact with hardwood fibers is, of course, due to hardwood fibers consistently having shorter fiber lengths than softwood fibers. As used herein, the maximum dimensions are measured across the syncline 18.

Figure 1B:
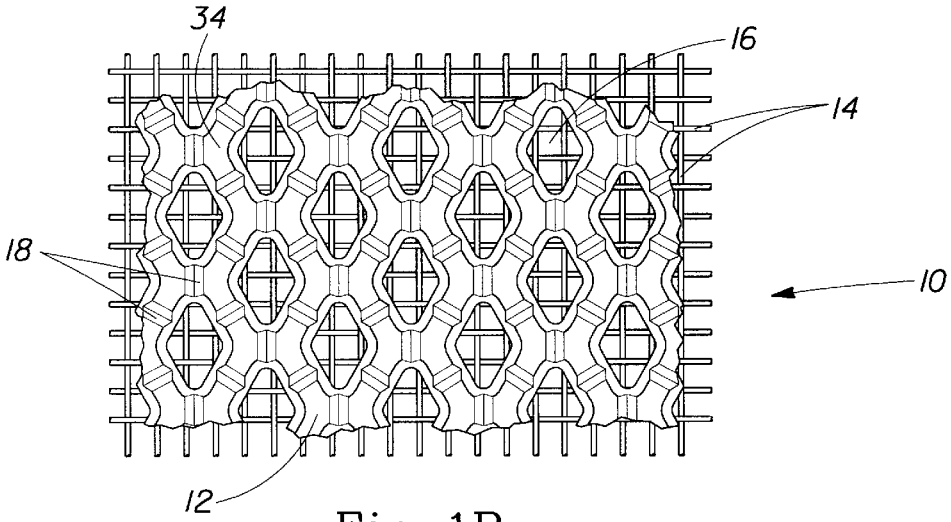
FIGS. 1B–1C are fragmentary top plan views of alternative papermaking belts, similar to that of FIG. 1A, but having an anisotropic disposition of the synclines.
Figure 1C:
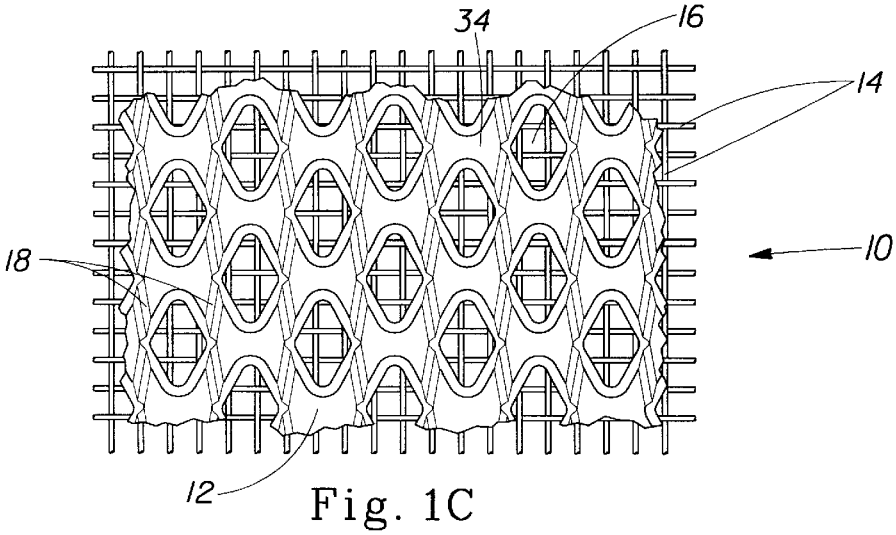

As illustrated in FIGS. 1A–1C, each syncline 18, may preferably intercept at least one deflection conduit 16. The syncline 18 extends away from that deflection conduit 16. Preferably, the syncline 18 extends from a first deflection conduit 16 towards an adjacent deflection conduit 16. It is to be recognized the deflection conduits 16 may be bilaterally staggered as shown in the aforementioned patents incorporated herein by reference, yet still be adjacent one another.

Preferably, the synclines 18 connect adjacent deflection conduits 16. A plurality of synclines 18 may intercept a given deflection conduit 16. In this arrangement, the plurality of synclines 18 may be circumferentially spaced apart around that deflection conduit 16. One or more of the synclines 18 in that plurality may intercept adjacent deflection conduits 16 and provide for and be part of a plurality of circumferentially spaced apart synclines 18 around the other deflection conduits 16 as well. As shown, if circumferentially spaced apart synclines 18 are utilized, the synclines 18 may be substantially equally circumferentially spaced from one another.

The paper 20 according to the present invention may be through-air dried or conventionally dried as taught in any of commonly assigned U.S. Pat. Nos. 4,514,345, issued Apr. 30, 1985 to Johnson et al.; 4,528,239, issued Jul. 9, 1985 to Trokhan; 5,098,522, issued Mar. 24, 1992; 5,260,171, issued Nov. 9, 1993 to Smurkoski et al.; 5,275,700, issued Jan. 4, 1994 to Trokhan; 5,328,565, issued Jul. 12, 1994 to Rasch et al.; 5,334,289, issued Aug. 2, 1994 to Trokhan et al.; 5,431,786, issued Jul. 11, 1995 to Rasch et al.; 5,496,624, issued Mar. 5, 1996 to Stelljes, Jr. et al.; 5,500,277, issued Mar. 19, 1996 to Trokhan et al.; 5,514,523, issued May 7, 1996 to Trokhan et al.; 5,554,467, issued Sep. 10, 1996, to Trokhan et al.; 5,566,724, issued Oct. 22, 1996 to Trokhan et al.; 5,624,790, issued Apr. 29, 1997 to Trokhan et al.; 5,628,876 issued May 13, 1997 to Ayers et al.; 5,679,222 issued Oct. 21, 1997 to Rasch et al.; 5,714,041 issued Feb. 3, 1998 to Ayers et al.; and 5,906,710, issued May 25, 1999 to Trokhan, the disclosures of which are incorporated herein by reference.

The paper 20 may optionally be foreshortened, as is known in the art. Foreshortening can be accomplished by creping the paper 20 from a rigid surface, and preferably from a cylinder. A Yankee drying drum is commonly used for this purpose. Creping is accomplished with a doctor blade as is well known in the art. Creping may be accomplished according to commonly assigned U.S. Pat. No. 4,919,756, issued Apr. 24, 1992 to Sawdai, the disclosure of which is incorporated herein by reference. Alternatively or additionally, foreshortening may be accomplished via wet microcontraction as taught in commonly assigned U.S. Pat. No. 4,440,597, issued Apr. 3, 1984 to Wells et al., the disclosure of which is incorporated herein by reference.

Foreshortened paper 20 is typically more extensible in the machine direction than in the cross machine direction. Creped or wet microcontracted paper 20 is readily bendable about hinge lines formed by the foreshortening process, which hinge lines extend generally in the cross-machine direction. Foreshortened paper 20 is less flexible about a line oriented generally parallel the machine direction because there are typically fewer hinge line s parallel the machine direction. Likewise, in a uncreped paper 20, or paper 20 which is not otherwise foreshortened, the anisotropic disposition can be used to compensate for differences generated by fiber orientation or the particular design of the papermaking belt 10. Paper 20 which is not dry creped and/or otherwise foreshortened, is contemplated to be within the scope of the present invention.

Referring to FIGS. 1B–1C, the synclines 18 may be anisotropically disposed as shown. Prophetically, such an anisotropic disposition can minimize the differences in properties, particularly flexibility, between the machine and cross-machine directions of the paper 20.

The belts of FIGS. 1B–1C prophetically reduce differences between machine direction flexibility and cross-machine direction flexibility by providing a papermaking belt 10, and thus a paper 20, having relatively more synclines 18 generally aligned with the machine direction than with the cross-machine direction. The synclines 18 generally aligned with the machine direction increase the flexibility of the paper 20 about such synclines 18, and would compensate for the absence of crepe lines (or other hinge lines) oriented generally parallel the machine direction.

In addition to the case illustrated by FIGS. 1A–1C and FIGS. 2A–2B, several other combinations of frameworks/synclines/deflection conduits are feasible. For example, referring to FIGS. 5A–5B, 8A–8B, 11A–11B, and 13A–13B, each belt 10 conceptually begins with a framework 12 which is semicontinuous. A semicontinuous framework 12 may be straight, sinusoidal or otherwise undulating. A semicontinuous framework 12 may be made according to the teachings of commonly assigned U.S. Pat. Nos. 5,628,876, issued May 13, 1997 to Ayers, et al. and 5,714,041 issued Feb. 13, 1998 to Ayers, et al., which patents are incorporated herein by reference.

Each of FIGS. 5A–5B, 8A–8B, 11A–11B, and 13A–13B also have semicontinuous deflection conduits 16. However, the embodiment of FIGS. 5A–5B have discontinuous synclines 18 and the embodiment of FIGS. 8A–8B have semicontinuous synclines 18. These synclines 18 thus divide an initially conceptually semicontinuous framework 12 into a framework 12 having a discontinuous pattern. In contrast, the embodiments of FIGS. 11A–11B and 13A–13B have discontinuous and semicontinuous synclines 18, respectively, preserving the semicontinuous nature of their respective frameworks 12. Thus, four different embodiments, as illustrated by FIGS. 5A–5B, 8A–8B, 11A–11B, and 13A–13B are feasible. FIGS. 11A–11B and 13A–13B yield a semicontinuous framework 12 whereas FIGS. 5A–5B and 8A–8B are further divided into a framework 12 having a discontinuous pattern.

Referring to FIGS. 7A–7B, 9A–9B, 10A–10B, 12A–12B, and 14A–14B, each belt 10 conceptually begins with a framework 12 having an essentially continuous pattern as discussed above. Each also has discontinuous deflection conduits 16. However, the embodiments of FIGS. 7A–7B have semicontinuous synclines 18 which effectively divide the framework 12 into a discontinuous pattern. Likewise, the embodiments of FIGS. 9A–9B have continuous synclines 18 which divide each framework 12 into a discontinuous pattern. In contrast, the embodiments of FIGS. 10A–10B and 12A–12B have discontinuous and semicontinuous synclines 18, respectively. The synclines 18 of FIGS. 10A–10B and 12A–12B divide any continuous framework 12 into semicontinuous patterns. Two different semicontinuous patterns are shown for each of FIGS. 10A–10B and FIGS. 12A–12B. The embodiments of FIG. 14A–14B have discontinuous synclines 18 which preserve the continuous pattern of the framework 12.

Figure 6A:
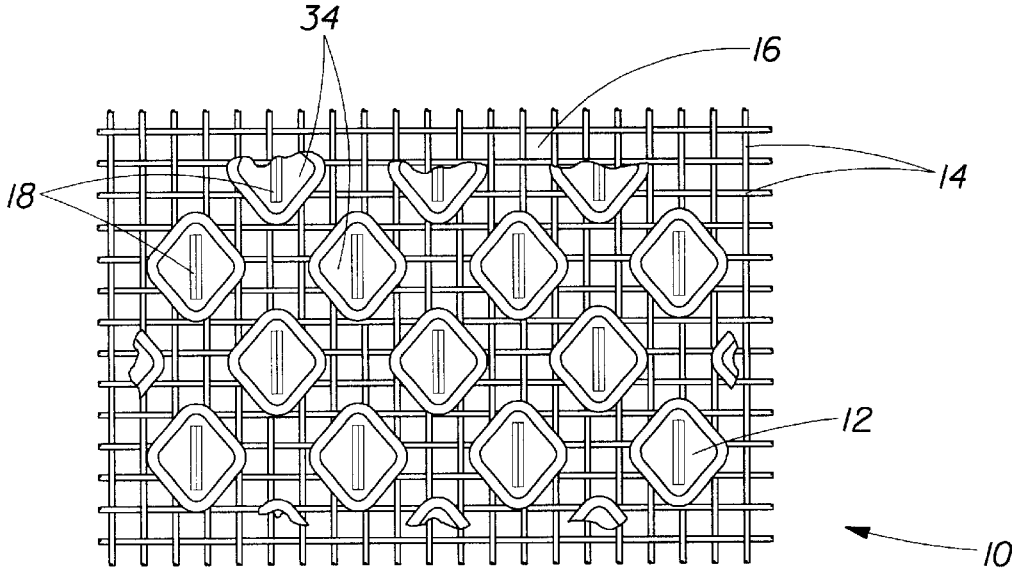
FIG. 6A is a top plan view of a papermaking belt having a discontinuous framework, discontinuous synclines and continuous deflection conduits.
Figure 6B:
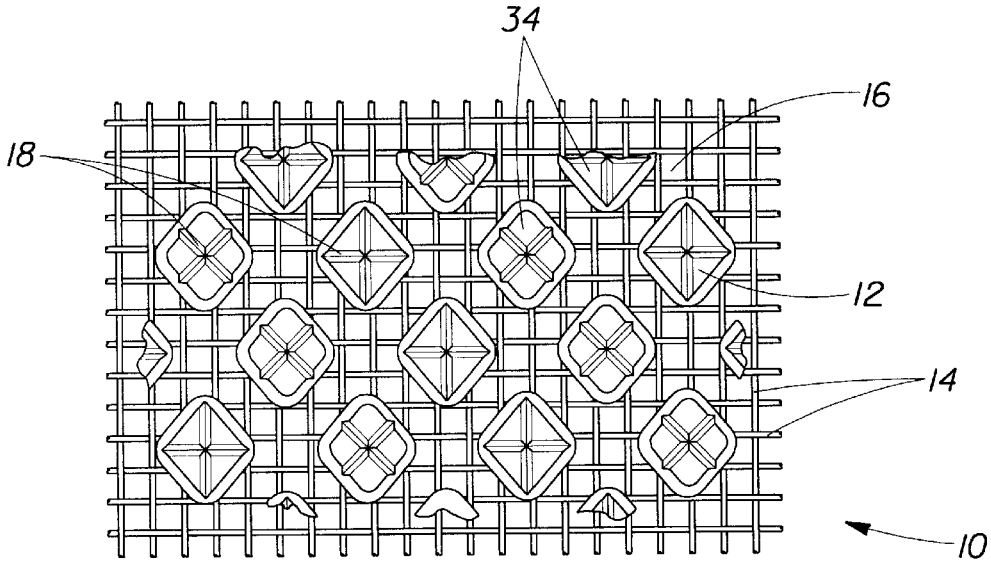
FIG. 6B is a top plan view of an alternative embodiment of the belt of FIG. 6A and having bilaterally extending synclines.
Figure 7A:
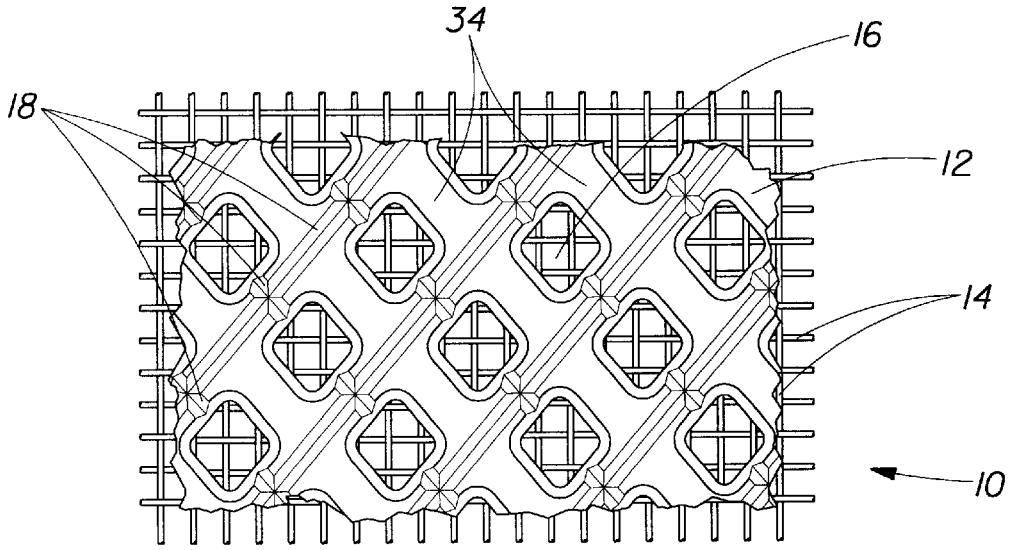
FIG. 7A is a top plan view of a papermaking belt having a discontinuous framework, semicontinuous synclines and discontinuous deflection conduits.
Figure 7B:
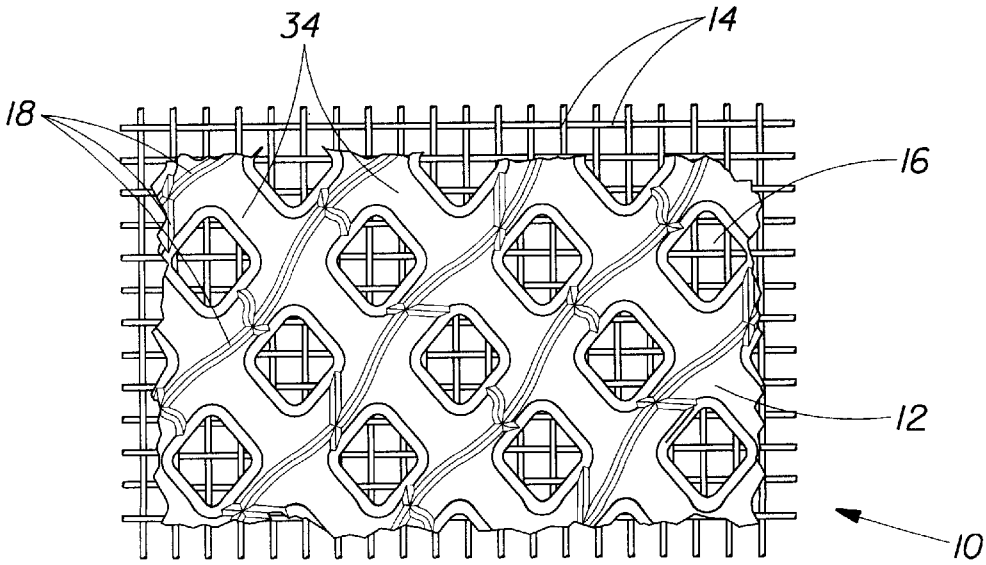
FIG. 7B is a top plan view of an alternative embodiment of the belt of FIG. 7A, having undulating semicontinuous synclines and synclines which are non-perpendicularly oriented but still connecting adjacent deflection conduits.
Figure 8A:
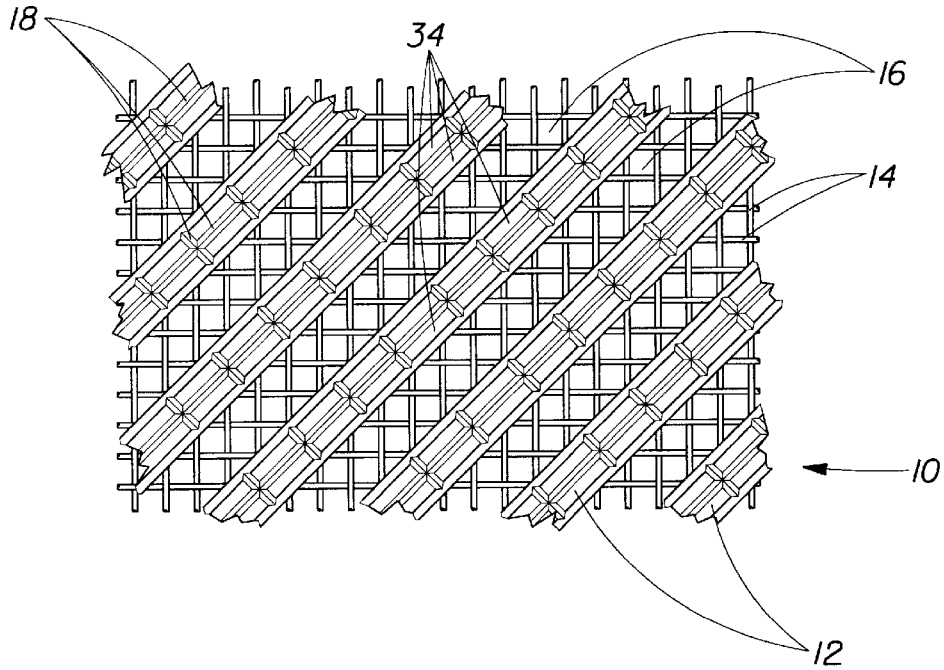
FIG. 8A is a top plan view of a papermaking belt having a discontinuous framework, semicontinuous synclines and semicontinuous deflection conduits.
Figure 8B:
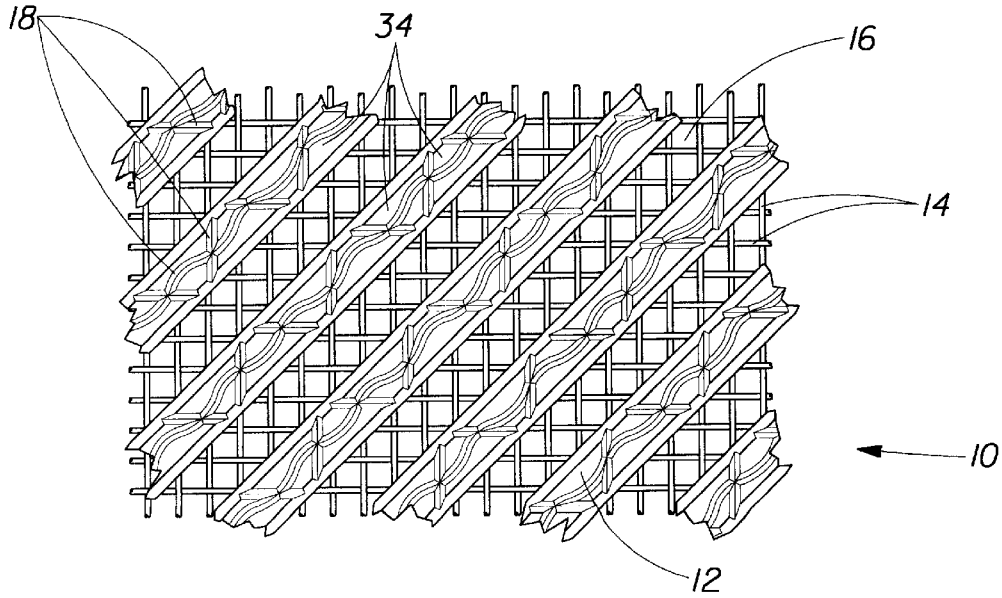
FIG. 8B is a top plan view of an alternative embodiment of the belt of FIG. 8A having sinusoidal synclines and synclines which are non-perpendicularly oriented relative to the framework and deflection conduits.
Figure 9A:
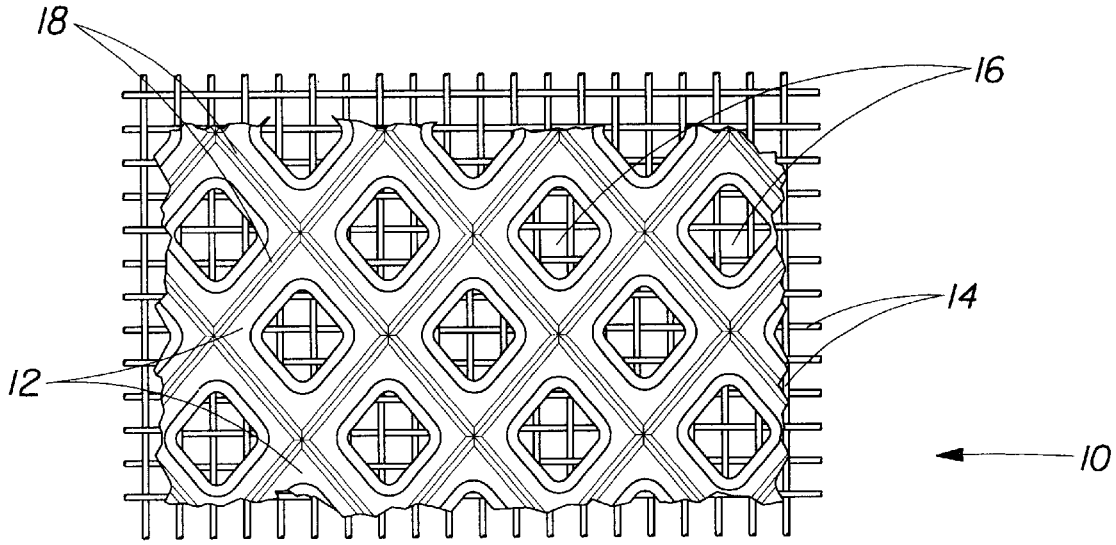
FIG. 9A is a top plan view of a papermaking belt having a discontinuous framework, continuous synclines and discontinuous deflection conduits.
Figure 9B:
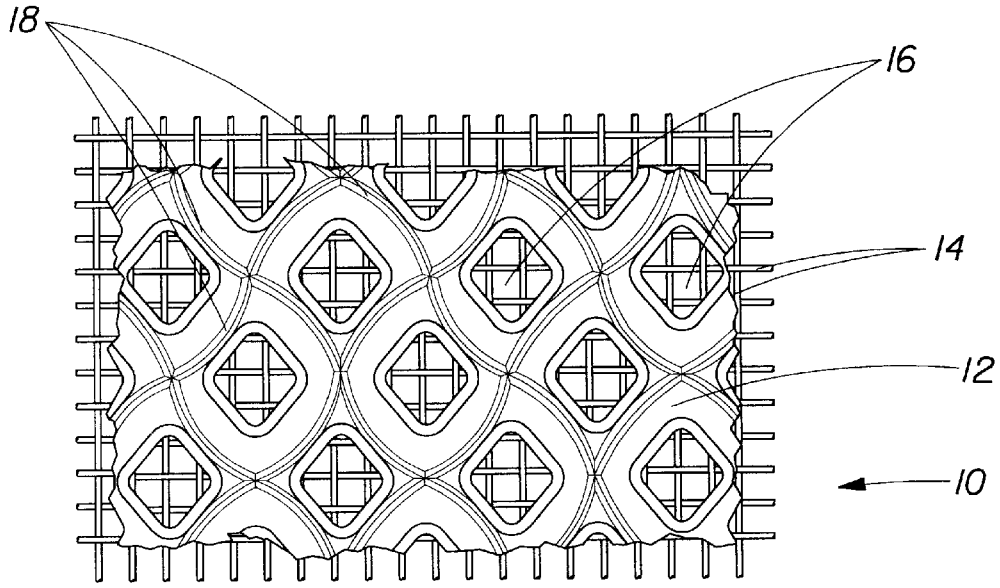
FIG. 9B is a top plan view of an alternative embodiment of the belt of FIG. 9A and having sinusoidally undulating synclines.
Figure 10A:
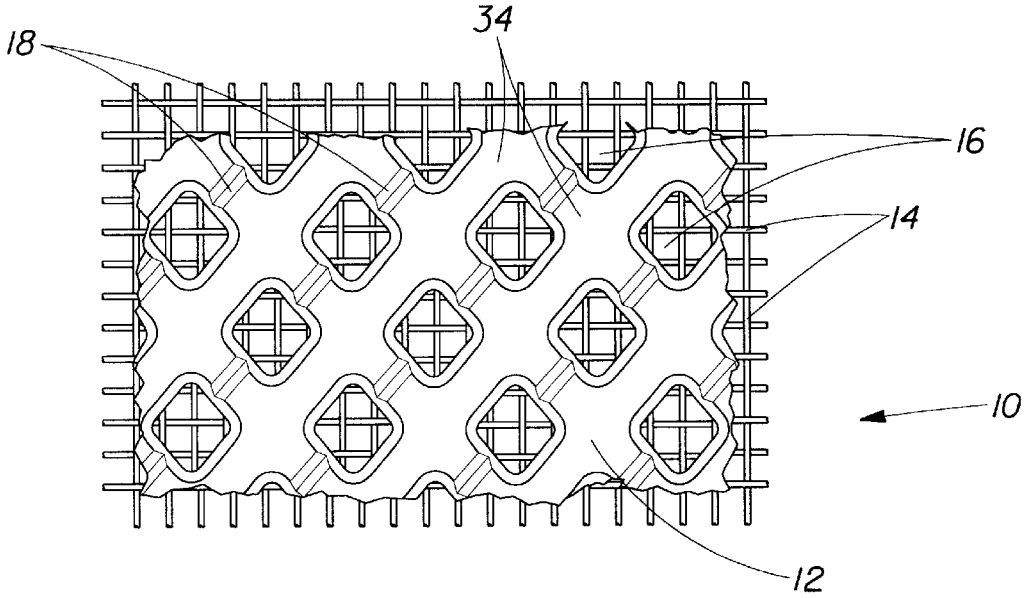
FIG. 10A is a top plan view of a belt having a semicontinuous framework, discontinuous synclines and discontinuous deflection conduits.
Figure 10B:
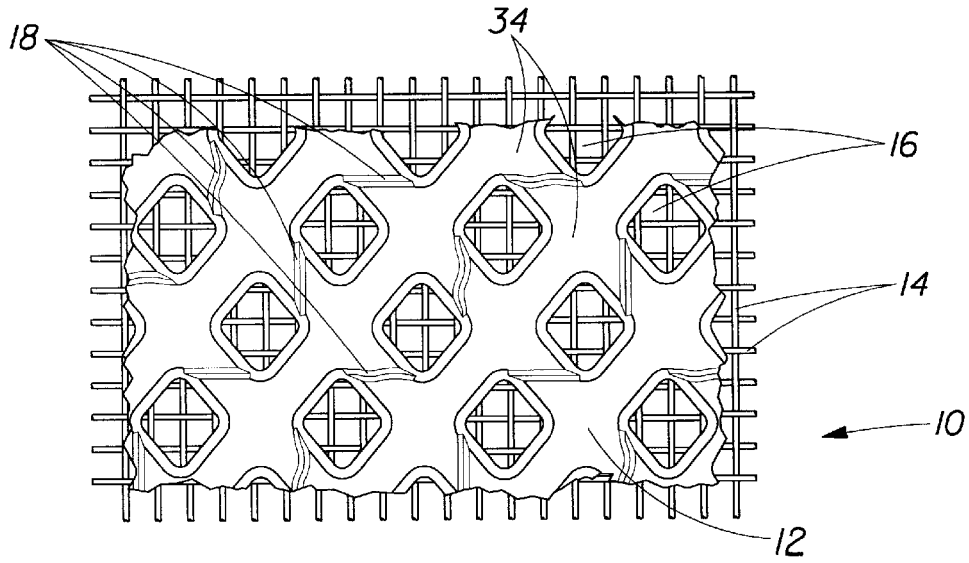
FIG. 10B is a top plan view of an alternative embodiment of the belt of FIG. 10A and having synclines nonperpendicularly oriented and connecting adjacent deflection conduits.
Figure 11A:
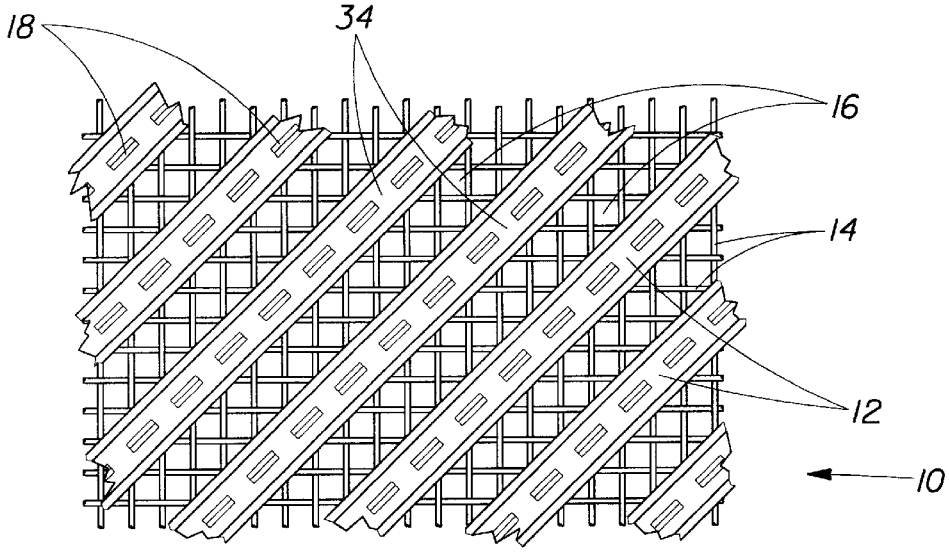
FIG. 11A is a top plan view of a papermaking belt having a semicontinuous framework, discontinuous synclines and semicontinuous deflection conduits.
Figure 11B:
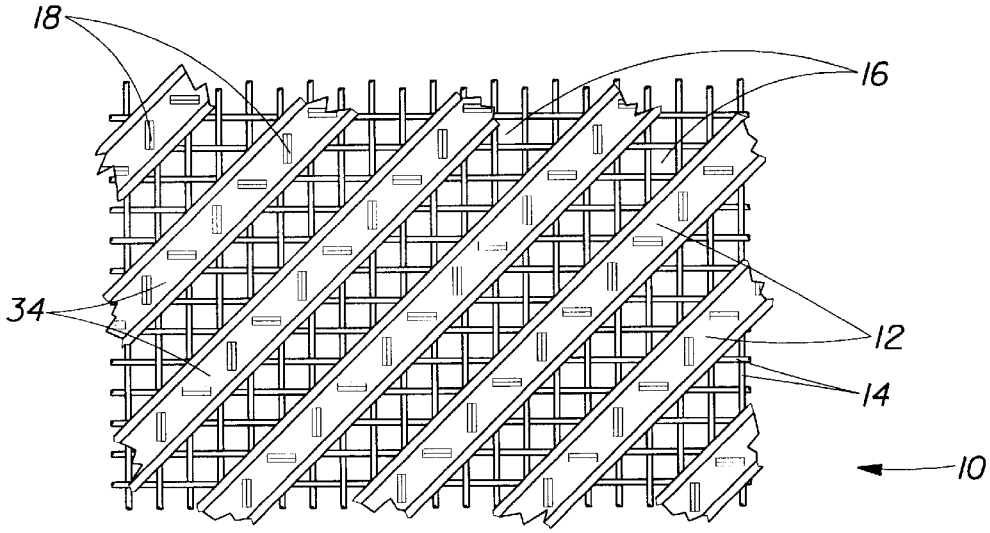
FIG. 11B is a top plan view of an alternative embodiment of the belt of FIG. 11A and having synclines which are neither parallel to nor perpendicular to the deflection conduits and framework.
Figure 12A:
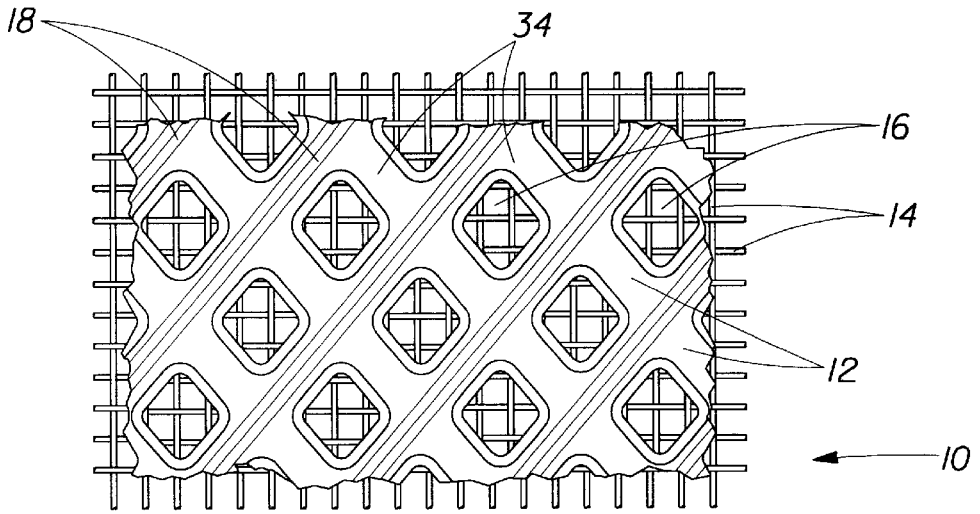
FIG. 12A is a top plan view of a papermaking belt having a semicontinuous framework, semicontinuous synclines and discontinuous deflection conduits.
Figure 12B:
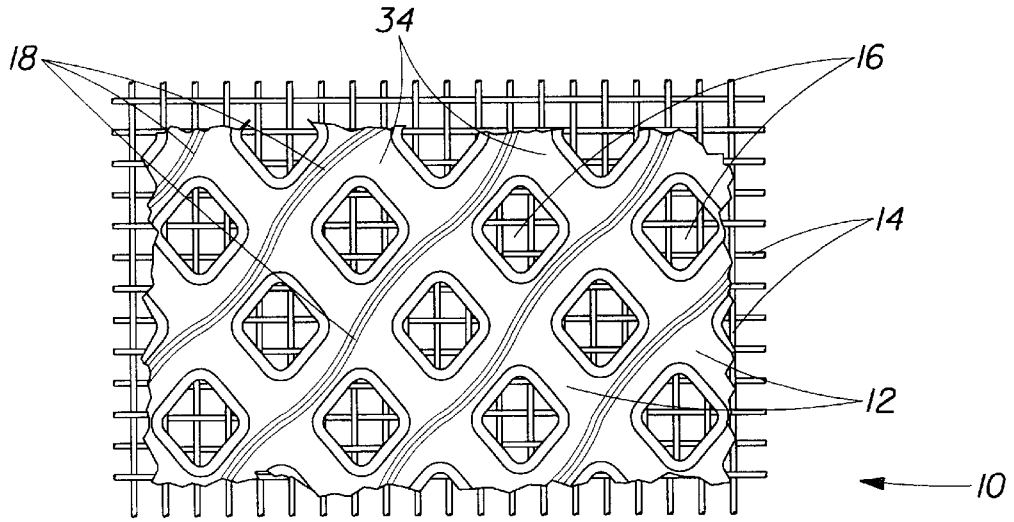
FIG. 12B is a top plan view of an alternative embodiment of the belt of FIG. 12A and having sinusoidally undulating synclines.
Figure 13A:
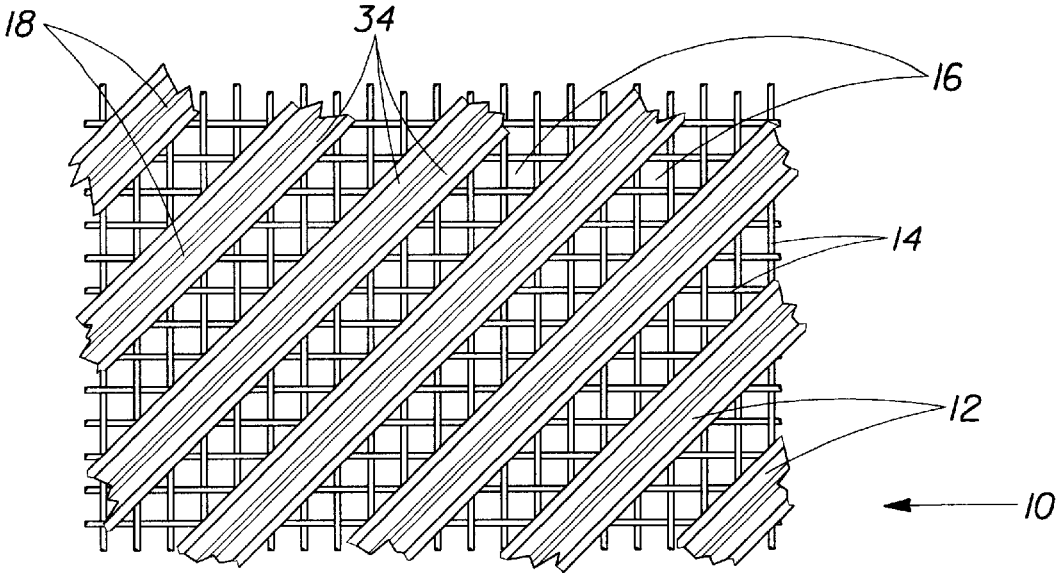
FIG. 13A is a top plan view of a papermaking belt having a semicontinuous framework, semicontinuous synclines and semicontinuous deflection conduits.
Figure 13B:
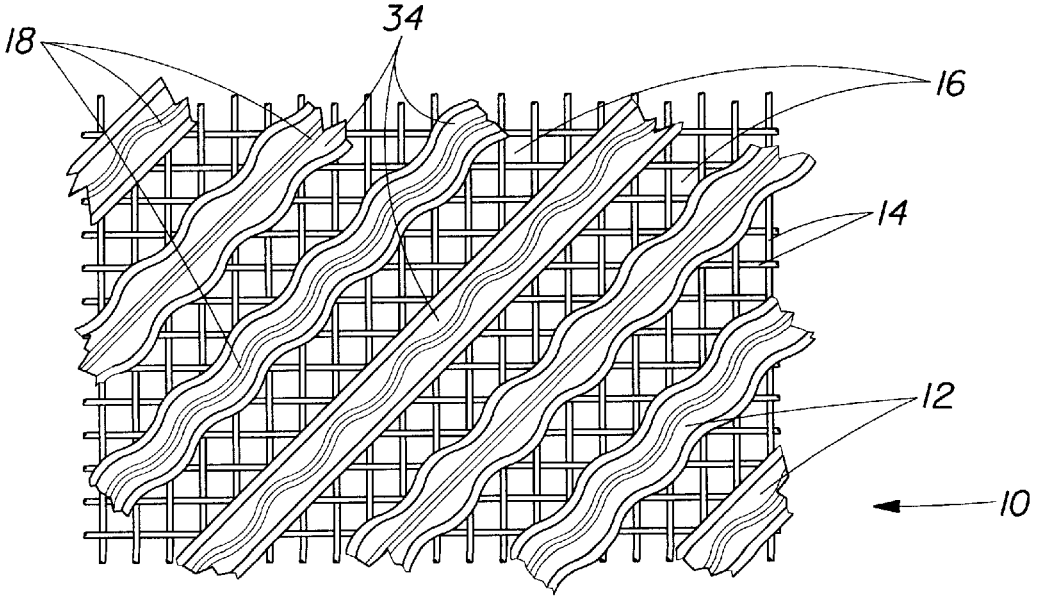
FIG. 13B is a top plan view of an alternative embodiment of the belt of FIG. 13A and having straight and sinusoidally undulating framework elements and synclines.
Figure 14A:
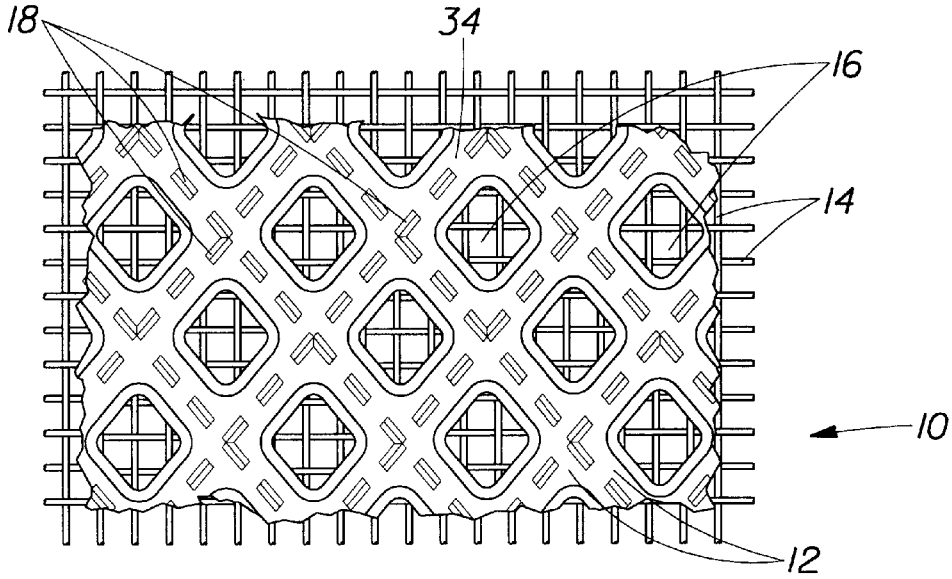
FIG. 14A is a top plan view of a papermaking belt having a continuous framework, discontinuous synclines and discontinuous deflection conduits.
Figure 14B:
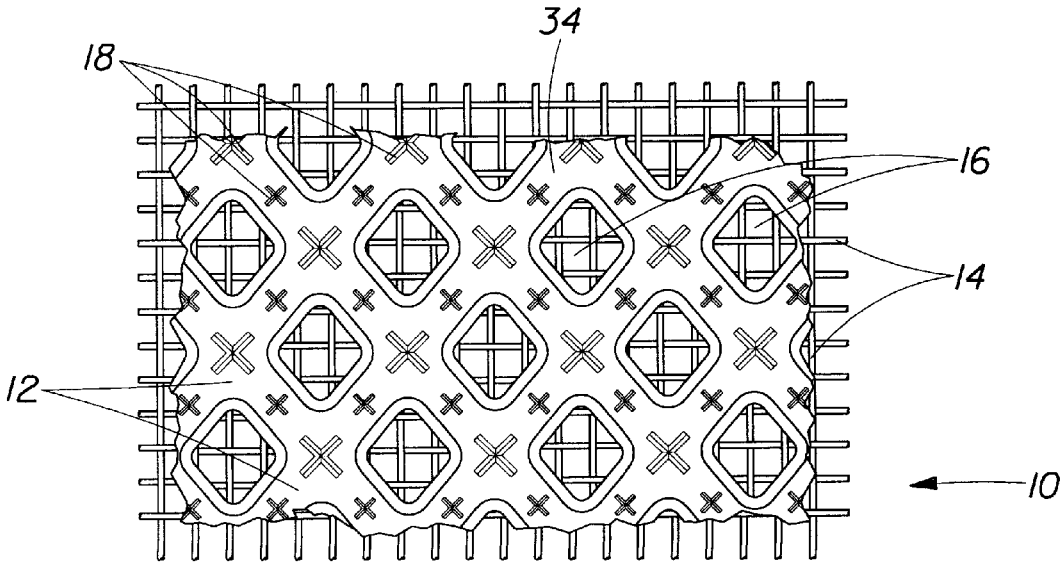
FIG. 14B is a top plan view of an alternative embodiment of the belt of FIG. 14A and having bilaterally extending synclines. Two sizes of synclines are shown, depending upon the position of the syncline relative to the deflection conduits.

Referring to FIGS. 6A–6B, in these embodiments each framework 12 is discontinuous. A discontinuous framework 12 may be produced in accordance with commonly assigned U.S. Pat. Nos. 4,514,345, issued Apr. 30, 1985 to Johnson, et al.; 5,245,025, issued Sep. 14, 1993 to Trokhan et al.; 5,527,428 issued Jun. 18, 1996 to Trokhan et al.; 5,534,326 issued Jul. 9, 1996 to Trokhan et al.; 5,654,076, issued Aug. 5, 1997 to Trokhan et al.; 5,820,730, issued Oct. 13, 1998 to Phan et al.; 5,277,761, issued Jan. 11, 1994 to Phan et al.; 5,443,691, issued Aug. 22, 1995 to Phan et al.; 5,804,036 issued Sep. 8, 1998 to Phan et al.; 5,503,715, issued Apr. 2, 1996 to Trokhan et al.; 5,614,061, issued Mar. 25, 1997 to Phan et al.; and 5,804,281 issued Sep. 8, 1998 to Phan et al., which patents are incorporated herein by reference. The embodiments of FIGS. 6A–6B further have discontinuous synclines 18 and continuous deflection conduits 16.

Referring to Table I below, 11 different cases are presented having the known permutations of discontinuous, semicontinuous and continuous frameworks 12, synclines 18 and deflection conduits 16. By examining the Figures and Table I, four general rules can be formulated. First, there is not a case having two continuous regions. Second, there is not a case having a continuous region and a semicontinuous region. Third, a framework 12 which conceptually begins with an essentially continuous pattern can be subdivided by the synclines 18 into a framework having a semicontinuous or d discontinuous pattern. Fourth, a framework 12 which conceptually begins with a semicontinuous pattern can be subdivided by the synclines 18 into a discontinuous pattern.

TABLE I

| Belt Figure | Framework | Syncline | Deflection Conduit |
|---|---|---|---|
| 1A, 1B | Discontinuous | Discontinuous | Discontinuous |
| 5A, 5B | Discontinuous | Discontinuous | Semicontinuous |
| 6A, 6B | Discontinuous | Discontinuous | Continuous |
| 7A, 7B | Discontinuous | Semicontinuous | Discontinuous |
| 8A, 8B | Discontinuous | Semicontinuous | Semicontinuous |
| 9A, 9B | Discontinuous | Continuous | Discontinuous |
| 10A, 10B | Semicontinuous | Discontinuous | Discontinuous |
| 11A, 11B | Semicontinuous | Discontinuous | Semicontinuous |
| 12A, 12B | Semicontinuous | Semicontinuous | Discontinuous |
| 13A, 13B | Semicontinuous | Semicontinuous | Semicontinuous |
| 14A, 14B | Continuous | Discontinuous | Discontinuous |

Of course, one will realize many variations and combinations are feasible. For example, synclines 18 having various combinations of angles and undulations may be utilized. The synclines 18 may be of varying widths.

Additionally, multiple cases may be utilized in the same papermaking belt 10. For example, the semicontinuous frameworks 12 of FIGS. 5A–5B, 8A–8B, 11A–11B, and 13A–13B having two different kinds of discontinuous and two by different kinds of semicontinuous synclines 18 may be selected.

Referring to FIG. 4, as disclosed in the aforementioned patents incorporated herein by reference, the belt 10 according to the present invention may be made by curing a photosensitive resin through a mask 40. The mask 40 has first regions 42 which are transparent to actinic radiation (indicated by the arrows) and second regions 44 which are opaque to the actinic radiation. The regions 42 in the mask 40 which are transparent to the actinic radiation will form like regions in the photosensitive resin which cure and become the framework 12 of the belt 10 according to the present invention. Conversely, the regions 44 of the mask 40 which are opaque to the actinic radiation will cause the resin in the positions corresponding thereto to remain uncured. This uncured resin is removed during the beltmaking process and does not form part of the belt 10 according to the present invention.

In order to form the synclines 18 in the belt 10 according to the present invention, the mask 40 may have opaque lines 46 corresponding to the desired synclines 18. The opaque lines 46 are sufficiently narrow in width that radiation incident thereupon at any angle nearly perpendicular to the belt 10 is blocked from penetrating the belt 10 to any depth 30. That portion of resin centered under and immediately below the opaque line 46 will not receive radiation at any depth 30. However, as the angle of incidence of the radiation decreases (becomes less perpendicular and more parallel to the surface), the depth 30 of the syncline 18 correspondingly decreases.

It will be apparent to one of ordinary skill that as the desired depth 30 of the synclines 18 increases, the width of the opaque line 46 should likewise increase. Of course, the opaque lines 46 may be applied in any desired pattern corresponding to the pattern desired for the synclines 18. For the embodiments described herein, having a syncline 18 with a maximum depth 30 of 0.2 to 75 mils., an appropriate opaque line 46 width is from 0.001 inches to 0.040 inches, depending upon the perpendicularity of the radiation incident upon the belt 10 and the amount of curing energy imparted to the resin.

Figure 3:
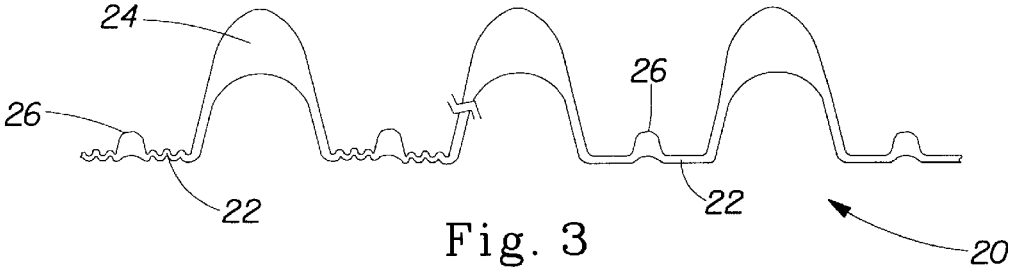
FIG. 3 is a fragmentary side elevational view of paper made using the belts of FIGS. 1 and 2A–2B, the left side of the figure being shown foreshortened, the right side of the figure being shown without creping or microcontraction.

Referring to FIG. 3, the paper 20 of the present invention has three primary regions: a first region 22, a second region of domes 24, and a third region of synclines 26. The first region 22 may be imprinted. The imprinted region 22 of the paper 20 is made on the framework 12 of the papermaking belt 10 described above and will generally correspond thereto in geometry and be disposed very closely thereto in position during papermaking.

The second region of the paper 20 comprises a plurality of domes 24 dispersed throughout the imprinted region 22. The domes 24 generally correspond in geometry, and in position during papermaking, to the deflection conduits 16 in the belt 10. The domes 24 protrude outwardly from the imprinted region 22 of the paper 20, by deflecting into and conforming to the deflection conduits 16 during the papermaking process. By conforming to the deflection conduits 16 during the papermaking process, the fibers comprising the domes 24 are deflected in the Z-direction between the paper facing surface of the framework 12 and the paper facing surface of the reinforcing element 14.

The synclines 26 o f the paper 20 correspond in geometry and position to the synclines 18 of the belt 10. The synclines 26 are neither imprinted by the framework 12 nor enter the deflection conduits 16 of the belt 10. The third region of synclines 26 provides the benefit that hinge lines are formed within the imprinted region 22 of the resulting paper 20.

Without being bound by theory, it is believed the domes 24, the imprinted regions 22 of the paper 20, and the synclines 26 may have generally equivalent basis weights. By deflecting the domes 24 into the deflection conduits 16, the density of the domes 24 is decreased relative to the density of the imprinted regions 22. The undeflected regions 22 may be imprinted during papermaking as, for example, against a Yankee drying drum. If imprinted, the density of the imprinted regions 22 is increased relative to that of the domes 24 and synclines 26. The densities of the regions 22 not deflected into domes 24 and synclines 26 are higher than the density of the domes 24. The synclines 26 will likely have a density intermediate that of the imprinted regions 22 and domes 24 of the paper 20.

Referring still to FIG. 3, the paper 20 according to the present invention may be thought of as having three different densities. The highest density region will be the high density imprinted region 22. For the preferred embodiment described herein, the imprinted region 22 of the paper 20 corresponds in position to the framework 12 of the papermaking belt 10. The lowest density region of the paper 20 will be that of the domes 24, corresponding in position to the deflection conduits 16 in the papermaking belt 10. The synclines 26 in the paper 20, corresponding to the synclines 18 in the papermaking belt 10, will have a density intermediate that of the domes 24 and the imprinted region 22.

Of course, one of ordinary skill will recognize that the 11 cases presented in Table I will produce 11 corresponding cases of paper 20 having high, medium and low density regions, as illustrated in Table II below.

TABLE II

| Belt Figure | High Density Region | Med. Density Region | Low Density Region |
|---|---|---|---|
| 1A, 1B | Discontinuous | Discontinuous | Discontinuous |
| 5A, 5B | Discontinuous | Discontinuous | Semicontinuous |
| 6A, 6B | Discontinuous | Discontinuous | Continuous |
| 7A, 7B | Discontinuous | Semicontinuous | Discontinuous |
| 8A, 8B | Discontinuous | Semicontinuous | Semicontinuous |
| 9A, 9B | Discontinuous | Continuous | Discontinuous |
| 10A, 10B | Semicontinuous | Discontinuous | Discontinuous |
| 11A, 11B | Semicontinuous | Discontinuous | Semicontinuous |
| 12A, 12B | Semicontinuous | Semicontinuous | Discontinuous |
| 13A, 13B | Semicontinuous | Semicontinuous | Semicontinuous |
| 14A, 14B | Continuous | Discontinuous | Discontinuous |

Likewise, the three regions of the paper 20 according to the present invention may be thought of as being disposed at three different elevations. As used herein, the elevation of a region refers to its distance from a reference plane. For convenience, the reference plane is horizontal and the elevational distance from the reference plane is vertical. The elevation of a particular region of the paper 20 according to the present invention may be measured using any non-contacting measurement device suitable for such purpose as is well known in the art. A particularly suitable measuring device is a non-contacting Laser Displacement Sensor having a beam size of 0.3×1.2 millimeters at a range of 50 millimeters. Suitable non-contacting Laser Displacement Sensors are sold by the Idec Company as models MX1A/B. Alternatively, a contacting stylis gauge, as is known in the art, may be utilized to measure the different elevations. Such a stylis gauge is described in commonly assigned U.S. Pat. No. 4,300,981 issued to Carstens and incorporated herein by reference.

The paper 20 according to the present invention is placed on the reference plane with the imprinted region 22 in contact with the reference plane. The domes 24 and synclines 26 extend vertically away from the reference plane. In this arrangement, the vertices 35 of the synclines 18 will be disposed intermediate the domes 24 and the imprinted region 22.

Optionally, the paper 20 according to the present invention may be foreshortened. The optional foreshortening may be accomplished by creping or by wet microcontraction. Creping and wet microcontraction are disclosed in commonly assigned U.S. Pat. Nos. 4,440,597, issued to Wells et al. and 4,191,756, issued to Sawdai, the disclosures of which patents are incorporated herein by reference. Foreshortening the paper 20 may make it more desirable to use anisotropically arranged synclines 18, as discussed above. Of course, the paper 20 made according to the present invention need not be foreshortened at all.

It will be recognized that several variations in the paper 20 according to the present invention are feasible. For example, the resulting paper 20 20 may be joined together to make a laminate, etc. Furthermore, the paper 20 made according to the present invention may be air laid or otherwise made with less water than occurs in conventional wet laid systems commonly known in the art.

While the foregoing cellulosic structures, particularly tissue, have been described in terms of density and basis weight, it is to be recognized that the three region structures may be described in terms of other properties as well. For example, intensive properties such as opacity, absorbency and caliper may be executed in the same manner as described above with respect to density and basis weight. Furthermore, the invention may be applied to other sheet goods, such as nonwoven materials, dryer-added fabric softeners, topsheets/backsheets for disposable absorbent articles such as diapers and sanitary napkins, etc.

Furthermore, variations in the papermaking belt 10 are feasible. For example, the synclines 18 could be made by having translucent or other such lines 46 in the mask 40 which have a transparency/opaqueness intermediate that of the first regions 42 and the second regions 44 of the mask 40. For example, instead of opaque lines 46 in the mask 40, the synclines 18 may be formed by regions which have an intermediate gray level and allow limited penetration of the incident radiation.

Other variations are also feasible. For example, a particular papermaking belt 10 may have two or more pluralities of synclines 18. A first plurality of synclines 18 may have a first depth 30 and/or width. A second plurality of synclines 18 may have a second depth 30 and/or width, etc. The pitch, amplitude and even the existence of the undulations may vary within a given papermaking belt 10.

In the description of the invention, varying embodiments and/or individual features are disclosed. It will be apparent all combinations of such embodiments and features are possible and can result in preferred executions of the invention.

What is claimed is:

1. A permeable papermaking belt defining an XY plane and having a Z-direction orthogonal thereto, said belt comprising a reinforcing element and a framework, said framework comprising a macroscopically monoplanar, network surface, said network surface being interrupted by synclines therein which do not extend completely through said framework in the Z-direction.

2. A papermaking belt according to claim 1 wherein said network surface is essentially continuous and defines a plurality of discrete deflection conduits therein.

3. A papermaking belt according to claim 2 wherein said synclines intercept at least one said deflection conduit and extend towards an adjacent deflection conduit.

4. A papermaking belt according to claim 3 wherein said synclines connect two adjacent deflection conduits.

5. A papermaking according to claim 3 comprising a first plurality of synclines intercepting each deflection conduit, said first plurality of synclines being substantially equally circumferentially spaced apart around said deflection conduit.

6. A papermaking belt according to claim 1 wherein said network surface is semicontinuous.

7. A papermaking belt according to claim 6 wherein said synclines are discontinuous.

8. A papermaking belt according to claim 1 wherein said framework is discontinuous.

9. A papermaking belt according to claim 8 wherein said synclines and said deflection conduits are discontinuous.

10. A papermaking belt according to claim 9 wherein said synclines do not intercept said deflection conduits.

11. A papermaking belt according to claim 10 wherein said synclines comprise an essentially continuous network, said essentially continuous network of said synclines being contained within said essentially continuous network of said surface.

12. A papermaking belt according to claim 1 having a first plurality of synclines and a second plurality of synclines, said first plurality of synclines having a different depth than said second plurality of synclines.

13. A papermaking belt for imprinting a paper web, said papermaking belt comprising a reinforcing element and a framework, said framework comprising a macroscopically monoplanar surface for imprinting a paper web and defining a plurality of deflection conduits adjacent one another, said surface being interrupted by synclines, whereby when said papermaking belt imprints a paper web against said surface, the regions of said paper web corresponding to said synclines are not imprinted.

14. A papermaking belt according to claim 13 wherein said synclines circumscribe said deflection conduits.

15. A papermaking belt according to claim 13 wherein each of said framework, synclines and deflection conduits are discontinuous.

* * * * *